United States Patent [19]

Willitts et al.

[11] 4,012,921

[45] Mar. 22, 1977

[54] REFRIGERATION AND HOT GAS DEFROST SYSTEM

[75] Inventors: Benjamin R. Willitts, Lawrenceville; Charles W. Klossman, Burlington, both of N.J.

[73] Assignee: Emhart Industries, Inc., Hartford, Conn.

[22] Filed: Jan. 7, 1976

[21] Appl. No.: 647,016

[52] U.S. Cl. ..... 62/151; 62/509; 62/199

[51] Int. Cl.[2] ..... F25B 39/04

[58] Field of Search ..... 62/278, 509, 81, 151, 62/196 R, 199, 196 B

[56] References Cited

UNITED STATES PATENTS

| | | | |
|---|---|---|---|
| 3,664,150 | 3/1972 | Patterson | 62/509 X |
| 3,905,202 | 9/1975 | Taft et al. | 62/196 B |

*Primary Examiner*—William E. Wayner
*Attorney, Agent, or Firm*—Sperry and Zoda

[57] ABSTRACT

A refrigeration system including at least one compressor, a condenser for receiving hot gaseous refrigerant from the compressor and condensing same, a discharge line for supplying hot gaseous refrigerant from the compressor to the condenser, a plurality of expansion valves associated with a plurality of evaporators, a liquid line for passing condensed refrigerant from the output of the condenser to the expansion valves and evaporators, a return line extending from the evaporators to the input of the compressor to supply refrigerant thereto, a receiver for holding a reservoir of refrigerant, a bypass line connecting the receiver to the liquid line, a hot gas defrost means for selectively passing hot gaseous refrigerant through one or more of the evaporators for defrost and a balancing line operable during defrost responsive to a pressure within the receiver greater than within the discharge line to provide fluid flow communication therebetween to equalize refrigerant pressure between the receiver and discharge line thereby allowing the system head pressure to rapidly increase to a level to initiate defrost flow. The present invention may also include a head pressure control solenoid operable to modulate flow through the discharge line responsive to a predetermined low pressure in the receiver during the defrost of any evaporator. Also the present system may include a receiver line connected between the receiver and the hot gas discharge line to maintain a minimum receiver pressure to insure full and efficient operation of the expansion valves associated with each evaporator.

14 Claims, 1 Drawing Figure

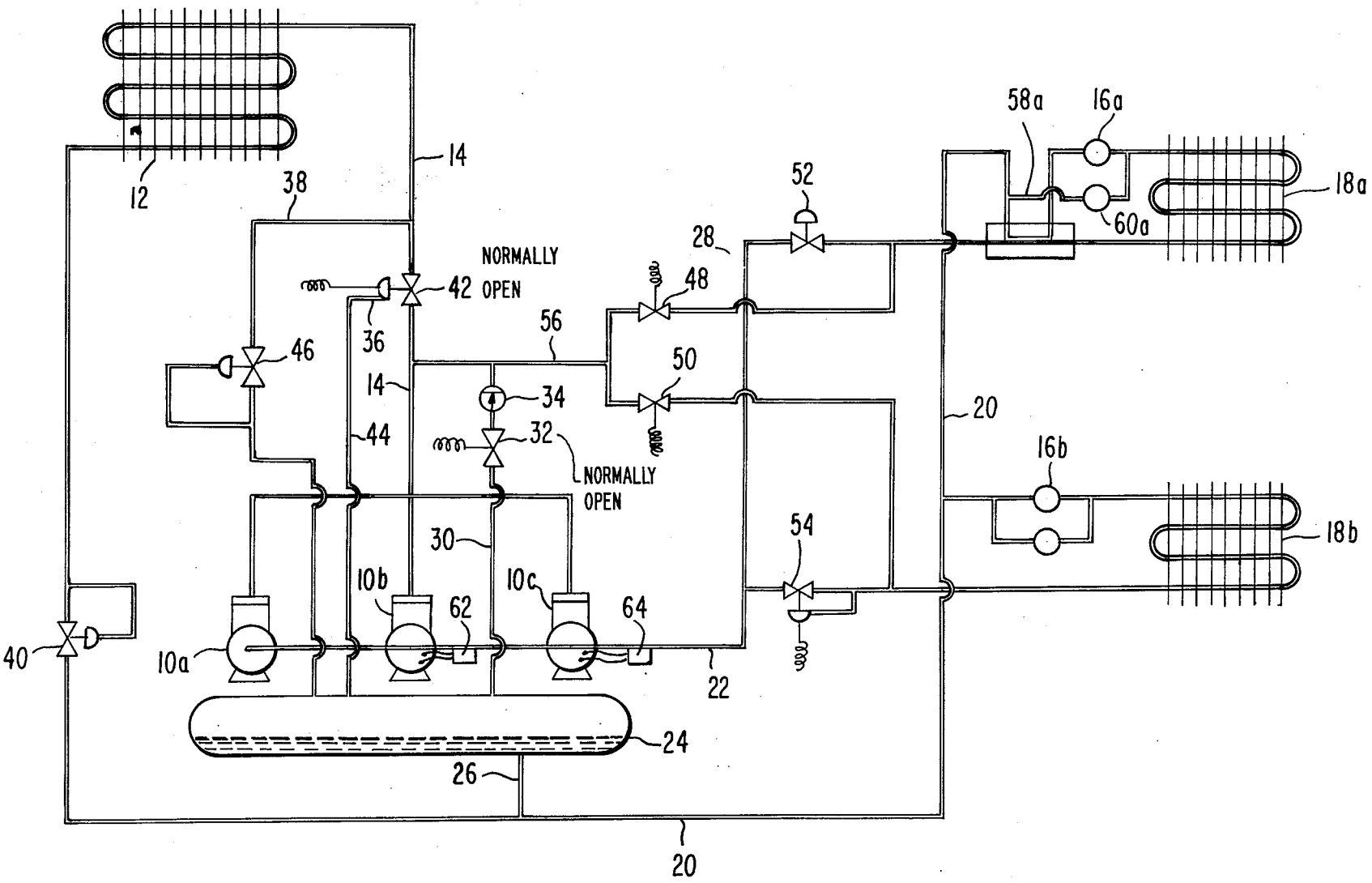
18a
18b
16a
60a
58a
16b
20
52
54
28
48
50
22
24
20
NORMALLY OPEN
64
56
34
32
10c
NORMALLY OPEN
42
30
62
26
14
36
14
44
10b
38
46
10a
12
40

REFRIGERATION AND HOT GAS DEFROST SYSTEM

BACKGROUND OF THE INVENTION

1. Field of Invention

The present system applies to the field of refrigeration systems applicable to use in large supermarket store fixtures and similar constructions. More particularly such refrigeration systems frequently effect defrosting by the passage of hot refrigerant gas directly from the output of the compressors to the evaporators which desire defrost. In this manner, the defrosting evaporator will cease refrigeration for a certain period of time and hot gaseous refrigerant will be drawn from the discharge line of the compressor to pass through the subject evaporator. During this period of time other evaporators or evaporator modules within the same system will continue to function in the refrigeration mode.

2. Description of the Prior Art

The most recent developments in the prior art are shown in U.S. Pat. No. 3,905,202 issued Sept. 16, 1975 in which an energy conserving refrigeration system is disclosed which is operable to defrost evaporator modules by the passage of hot gaseous refrigerant therethrough. That system includes valving operable to maintain reverse flow through defrosting evaporators by maintaining a pressure differential thereacross while at the same time maintaining a minimum receiver pressure sufficient to insure efficient operation of the expansion valves of all the evaporators and evaporator modules which are then currently operating in the refrigeration rather than defrosting mode.

In order to further increase the efficient operation of that system, the present invention includes a means for decreasing the hot gas defrosting cycle time. In this manner defrost can be accomplished in a shorter period of time and all evaporators within the entire refrigeration system will be operating in the refrigeration mode for a greater percentage of total operation time than is possible during the operation of the original system as disclosed in the above patent.

SUMMARY OF THE INVENTION

The present invention includes a compressor for compressing hot gaseous refrigerant for delivery through a discharge line to a condenser. The condenser receives the hot vapor and condenses the refrigerant for delivery to the expansion valves associated with each evaporator. A liquid line communicates the condensed liquid from the condenser to the expansion valves. Positioned within the liquid line may be a pressure modulating valve operable to maintain a predetermined desired pressure within the condenser to assure at least partial flooding thereof. The liquid line extends to the expansion valves which are positioned adjacent the evaporators. The evaporators are located in the areas desired to be refrigerated. A return line extends from the evaporators to the input of the compressors for supplying refrigerant gas thereto. Also included in this system is a receiver for holding sufficient refrigerant to assure a full supply of liquid refrigerant to the liquid line. Communication between the liquid line and the receiver is provided by a bypass line therebetween.

Defrosting of evaporators of the present system is achieved by selectively passing hot refrigerant gas through the defrosting evaporators. In this manner a quick and efficient means of defrosting is utilized. A defrosting line is connected to the discharge line of the compressors to supply the high temperature pressurized gaseous refrigerant to the defrosting operation. In order to assure defrost flow, a pressure regulating valve may be positioned in the discharge line operable to close responsive to a predetermined low pressure in the receiver. In this manner the flow of hot refrigerant gas to the condenser will be prevented whenever the refrigerant pressure within the defrosting lines is not a sufficient value greater than the receiver pressure. Therefor the solenoid valve will close whenever the head pressure is not sufficient to assure defrost flow. Also a receiver line with a solenoid or pressure regulating valve therein may extend between the receiver and the hot gas discharge line being operable to open whenever the pressure within the receiver is not sufficient to assure effective operation of the expansion valves. Whenever this condition exists a valve within the receiver line will open and communicate hot refrigerant vapor directly to the receiver to increase the pressure sufficient to operate the expansion valves.

Whenever the solenoids within the defrost lines open to allow defrosting of a particular evaporator or evaporator module, the pressure in the hot gas discharge line designated "head pressure" will suddenly drop to a level which is usually less than the receiver pressure. During this condition defrost flow will not be possible until the compressors presently operating have created a head pressure greater than the receiver pressure such that reverse flow through the defrosting evaporators is possible. During the time when the head pressure is building up to achieve defrost, a delay in the defrost cycle time occurs which undesirably extends the total defrost time. To decrease the defrost cycle time, a balancing line is provided extending from the receiver to the defrosting lines. This balancing line provides refrigerant flow communication between the receiver and the hot gas discharge line during a defrosting operation whenever the pressure in the receiver is greater than the pressure in the hot gas discharge and hot gas defrosting lines. This balancing line is useful immediately upon the opening of valving for defrosting of an evaporator. At this moment, the head pressure immediately drops since the load through the defrosting evaporator is added to the hot gas discharge circuit. Usually the drop in head pressure is so great that the receiver pressure will be greater than the head pressure for an initial period of time. To eliminate this initial delay period, the balancing line is operable to provide free refrigerant flow communication from the receiver to the defrosting lines whenever the receiver pressure is greater than the defrosting line pressure. As soon as the two pressures are balanced and equal, the balancing line will cease fluid flow communication. In this manner, the building of a pressure differential between the receiver pressure and the hot gas discharge pressure will be initiated immediately upon the opening of valving to effect defrost. Essentially, as soon as a defrosting operation is initiated the head pressure will be brought up to the value of the receiver pressure and instantaneously will be increased by the compressor to a value higher than the receiver pressure such that reverse flow through the defrosting evaporator will be possible.

The balancing line may have positioned therein a solenoid which is normally closed but is operable to open during a defrost whenever the receiver is greater than the pressure in the hot gas discharge line and hot gas defrosting lines. Also within the balancing line may be positioned a one-way valve such as a check valve or the like operable to allow flow from the receiver to the hot gas discharge line and the hot gas defrosting line while preventing refrigerant flow from the hot gas discharge line and the hot gas defrost line to the receiver.

It is an object of the present invention to provide a refrigeration system which may be more quickly and effectively defrosted.

It is an object of the present invention to provide a refrigeration system which uses hot refrigerant gas to defrost evaporators associated therewith in a rapid and efficient manner.

It is an object of the present invention to provide a means for quickly initiating defrost flow through an evaporator or evaporator module needing defrost.

It is an object of the present invention to provide a rapid means for achieving the required head pressure to assure full defrost flow of hot gas through a defrosting evaporator.

It is an object of the present invention to provide a means for eliminating the time delay caused by the large drop in head pressure which occurs when the defrost valving initially opens to effect hot gas defrost.

It is an object of the present invention to provide a means for maintaining the required receiver pressure to operate the expansion valves for evaporators in the refrigeration mode while at the same time maintaining a pressure difference between the defrosting lines and the liquid line sufficient to assure reverse flow through the evaporators by the defrosting refrigerant.

BRIEF DESCRIPTION OF THE DRAWING

While the invention is particularly pointed out and distinctly claimed in the concluding portions herein a preferred embodiment is set forth in the following detailed description which may be best understood when read in connection with the accompanying drawing, in which:

The FIGURE is a diagrammatical illustration of a refrigeration system embodying the present invention.

DETAILED DESCRIPTION OF THE PREFERRED EMBODIMENT

The present invention includes a compressor means 10 which is operable to compress gaseous refrigerant such that it is expelled into discharge line 14. Discharge line 14 communicates the hot gaseous refrigerant to condenser means 12 which is operable to be at least partially flooded such that full condensing of the compressed hot gaseous refrigerant supplied thereto by the discharge line will be effected. Condensed liquid refrigerant will pass from condenser means 12 through liquid line 20 to expansion valves 16 and evaporator means 18. The evaporators are placed in the environment in which cooling is required. The output of refrigerant from the evaporators passes through return line 22 to the input side of compressor means 10. To assure a sufficient supply of refrigerant within a system, a receiver means 24 is connected to liquid line 20 by a bypass line 26. Also included in the present system is a hot gas defrost means generally designated as 28 which is operable to pass warm gaseous refrigerant through evaporators for defrosting. A balancing line 30 is positioned from the receiver 24 to the defrost means 28 and discharge line 14 to maintain the refrigerant pressure within line 14 and defrost means 28 at a value equal to or greater than the refrigerant pressure within the receiver 24.

A pressure responsive valve 40 may be positioned within liquid line 20 to control the refrigerant pressure at the condenser 12. In particular, valve 40 is operable responsive to the condenser pressure to maintain a minimum condenser pressure such that partial or full flooding is achieved within the condenser. A discharge pressure control means 36 may be located within discharge line 14. As illustrated in the FIGURE the discharge pressure control means may be a solenoid or pressure regulating valve 42 which is operable to sense the pressure within receiver 24 through sensing line 44 and is also operable to sense the hot gas discharge pressure or head pressure. Valve 42 is normally open but is operable to close responsive to a head pressure which is lower than the sum of the receiver pressure and a fixed predetermined pressure differential. Therefore valve 42 in combination with sensing line 44 will close and prevent flow of refrigerant through discharge line 14 to condenser 12 whenever the head pressure is below a certain value.

In order to assure full and efficient operation of expansion valve 16, a receiver line 38 may be positioned extending from the receiver 24 to the discharge line 14. Preferably the connection of the receiver line to the discharge line will be at a point between the valve 42 and a condenser 12. Receiver line 38 may have positioned therein in a pressure regulating valve or solenoid actuated valve 46 which is normally closed but is responsive to a predetermined minimum receiver pressure to open and thereby communicate high pressure gaseous refrigerant directly to the receiver environment. In this manner a minimum receiver pressure will be maintained such that efficient operation of the expansion valve 16 will be assured.

Hot gas defrost means 28 may comprise any system which is adapted to pass warm refrigerant vapor through evaporators to effect defrost. In the FIGURE a hot gas discharge system is illustrated which takes hot compressed gaseous refrigerant from discharge line 14 for passage selectively through the evaporators desiring defrost. The defrost system includes valves 48, 50, 52 and 54, which are selectively operable to control the flow of hot gaseous refrigerant through the defrosting lines and at the same time to control the passage of refrigerant through the evaporators during refrigeration. In particular when a defrost of evaporator 18A is required, normally closed valve 48 will open and normally closed valve 50 will remain closed. Also, normally open valve 52 will close and normally open valve 54 will remain open. In this manner, hot gaseous refrigerant will flow through defrost line 56 through valve 48 and into evaporator 18A. The flow of defrosting refrigerant through evaporator 18A will be in a reverse direction to the flow of refrigerant during defrost. As the defrosting refrigerant exits evaporator 18A, it will pass around expansion valve 16A through bypass line 58A which has been rendered passable by the opening of valve 60A. The refrigerant will then pass directly into liquid line 20 and be available to supply refrigerant to expansion valve 16B which is presently operating since the evaporator 18B is functioning in the refrigeration mode. Similarly whenever evaporator 18B requires a defrost, normally open valve 54 will close and normally closed valve 50 will open to provide a path for the passage of hot refrigerant vapor in a reverse direction through evaporator 18B into liquid line 20.

The use of hot gas defrosting rather than other conventional mentods of defrosting such as electrical and the like has become widespread since hot gas defrost is a quicker and more effective means of defrost. In addition, energy is conserved by effecting defrost using the normal operation refrigerant of the system rather than an external defrosting energy source such as electrical resistance heating and the like. With the use of hot gas defrost, problems do occur in maintaining close control of the head pressure. These problems arise due to the varying loads to which the compressors are subjected. These loads vary greatly with the temperature of the environment used for condensing and with the amount of defrosting operation in a system at any particular chosen time. An attempt to provide a system which is adaptable to produce various compressor loads includes the use of multiple compressors shown in the FIGURE as 10A, 10B, and 10C. Under normal operating conditions the use of compressor 10A solely is sufficient and during such conditions, switches 62 and 64 will be operable to render compressors 10B and 10C inoperative. However, during periods of greater load demand upon the gaseous refrigerant passing through hot gas discharge line 14, switches 62 and 64 are operable to render either or both of compressors 10B and 10C operative. While such a system is minimally adaptable within limits to the hot gas discharge load, it is quite costly since the required compressor capacity installed in every system must be sufficient to supply the maximum possible load upon the hot gas discharge.

To eliminate the need for such excess compressing capacity various valving systems have been designed to closely control the pressurs within the refrigeration system. An example of such a system is shown in U.S. Pat. No. 3,905,202 which discloses a system capable of maintaining a minimum head pressure while at the same time maintaining a minimum receiver pressure sufficient to assure efficient operation of the expansion valves. A problem with such a refrigeration and defrosting system occurs immediately upon the initiation of a defrost.

When an evaporator such as 18A calls for a defrost the normally open valve 52 will close and normally closed valve 48 will open. At this time defrost valve 56 and all the defrosting piping for passing refrigerating vapor in a reverse direction through valve 18A will now be withdrawing hot gaseous refrigerant from discharge line 14. This great increase in load will cause the head pressure in line 14 to suddenly decrease. At such a time usually the pressure within discharge line 14 and defrosting line 56 will actually be lower than the pressure within the receiver 24. Under these conditions there will be no reverse defrost flow through evaporator 18A since a reverse pressure differential thereacross does not exist. The pressure of refrigerant within line 56 must be brought to a value greater than the pressure of refrigerant within liquid line 20 such that this reverse flow through evaporator 18A is possible.

In operation in response to these conditions, valve 42 will sense the pressure within the receiver 24 to be at a value greater than the pressure within line 14 and as such valve 42 will close. The flow of refrigerant from compressors 10 to condenser 12 will thereby momentarily cease. Valve 42 is operable to close in order to allow the head pressure within line 14 to build up to a predetermined value greater than the receiver pressure such that flow through condenser 12 will be made possible. Valve 42 is also operable to close to allow the head pressure to build up to assure defrosting flow through lines 56 and evaporator 18A. As noted, the pressure within line 56 and line 14 will usually drop below the refrigerant pressure within receiver 24. Thus a time delay is created within the system in which the compressors 10 must build up the refrigerant pressure within line 14 and 56 to a point equal to the pressure within receiver 24 and then further to a value greater than the pressure within receiver 24 such that reverse flow through evaporator 18A is possible.

The present invention discloses a means for decreasing this time delay between the initial call for defrost by evaporator and the time when a pressure difference is actually created the evaporator such that defrost flow is possible. To decrease this defrost cycle time a balancing line 30 is connected between receiver 24 and defrost line 56. This line may also be connected to liquid line 20 to sense the pressure within receiver 24 and/or the connection to defrosting line 56 may be connected to hot gas discharge line 14 which during defrost will be at approximately the same pressure as defrosting line 56.

Balancing line 30 may have positioned therein a solenoid 32 and a one-way valve such as a check valve 34. Check valve 34 oriented to allow refrigerant flow from receiver 24 to lines 14 and 56 but to prevent refrigerant flow from lines 14 and 56 to receiver 24. In this manner, during the normal refrigeration operation when the pressure within lines 14 and 56 is greater than the pressure within the liquid line 20 or receiver 24, flow through balancing line 30 to the receiver or to the liquid line 20 will be prevented. The balancing line 30 is normally closed but is operable to open upon the concurrence of two conditions. Firstly, the pressure within the liquid line 20 or the receiver 23 must be at a value greater than the pressure within discharge line 14 and defrosting line 56. Concurrently, at least one evaporator must be in the defrosting mode. Whenever both these conditions are met, normally closed solenoid 32 will open to allow the refrigerant at a greater pressure within liquid line 20 and receiver 24 to communicate through line 30 to defrosting line 56. In this manner simultaneously with the initiating of a defrost the refrigerant pressure within lines 14 and 56 will be brought to value equal with the refrigerant pressure within liquid line 20 and receiver 24. As soon as these two pressures have equalized the valve 34 will close and allow the refrigerant pressure within defrosting line 56 to increase to a value greater than the receiver pressure such that reverse flow through evaporator 18A is achieved. Therefore the time delay between a need for defrost and the initiation of defrosting flow will be decreased appreciably. The combination of valve 46 which maintains a receiver pressure sufficient to operate expansion valves 16, valve 42 which is operable to maintain head pressure greater than the receiver pressure and solenoid 32 which is operable to decrease the defrost cycle time provides a unique system for controlling a hot gas defrost refrigeration system which assures effective operation of all refrigeration systems while at the same time assures an effective and efficient rapid means of achieving hot gas defrosting operations.

While a particular embodiment of this invention has been shown in the drawing and described above, it will be apparent that many changes may be made in the form, arrangement and positioning in the various elements of the combination. In consideration thereof, it should be appreciated that preferred embodiments of this invention disclosed herein are intended to be illustrative only and not intended to limit the scope of the invention.

We claim:

1. A refrigeration and hot gas defrost system comprising:

a. a compressor means for compressing gaseous refrigerant;

b. a condenser means for condensing hot gaseous refrigerant received from said compressor means;

c. a discharge line communicating the output of said compressor means to said condenser means;

d. a plurality of expansion valves;

e. a plurality of evaporator means associated with each of said expansion valves;

f. a liquid line for passing the liquid refrigerant from the output of said condenser means to said expansion valves and said evaporator means;

g. a return line connecting said evaporator means to the input of said compressor means;

h. receiver means for holding a sufficient amount of refrigerant to assure efficient operation of the system;

i. a bypass line providing refrigerant flow between said liquid line and said receiver means;

j. defrost means for selectively passing hot refrigerant gases through at least one of said evaporator means to defrost the same; and k. a balancing line responsive to a pressure within said receiver greater than within said discharge line to provide fluid flow communication therebetween to equalize refrigerant pressure between said receiver and said discharge line.

2. The system as defined in claim 1 wherein said balancing line includes therein a normally closed solenoid operable whenever a defrost is required to open.

3. The system as defined in claim 2 including a one-way valve to allow refrigerant flow from said receiver into said discharge line and to prevent refrigerant flow from said discharge line into said receiver.

4. The system as defined in claim 1 including a discharge pressure control means responsive to a refrigerant pressure within said discharge line less than a value equal to the receiver pressure plus a predetermined value to prevent flow from said discharge line to said condenser to increase pressure within said discharge line.

5. The system as defined in claim 4 wherein said discharge pressure control means is operable only when a defrosting operation is required of any of said evaporator means.

6. The system as defined in claim 4 wherein said discharge pressure control means is a pressure responsive valve positioned within said discharge line.

7. The system as defined in claim 1 further comprising a receiver line connected from said discharge line to said receiver including a valve therein operable to maintain receiver pressure at a sufficiently high level to insure full and efficient operation of said expansion valves.

8. For use in a hot gas defrost refrigeration system having at least one compressor, a hot gas discharge line, at least one condenser, a receiver, a plurality of evaporators and associated valves, a hot gas defrost means for selectively passing hot gaseous refrigerant through a desired evaporator, the improvement which comprises a balancing line responsive to a greater refrigerant pressure within the receiver than within the discharge line to provide refrigerant flow communication therebetween to equalize refrigerant pressure therebetween.

9. The improvement as defined in claim 8 wherein said balancing line is responsive to equal refrigerant pressure within the hot gas discharge line and the receiver to prevent refrigerant flow through said balancing line.

10. The improvement as defined in claim 8 wherein said balancing line includes a normally closed valve means therein responsive to open whenever the refrigerant pressure within the receiver is greater than the refrigerant pressure within the hot gas discharge line.

11. The improvement as defined in claim 10 wherein said valve means includes a normally closed solenoid operable to open during a defrosting operation.

12. The improvement as defined in claim 8 wherein said balancing line includes a one-way check valve therein to prevent flow therethrough from the discharge line to the receiver and to allow flow therethrough from the receiver to the discharge line.

13. The improvement as defined in claim 8 wherein said balancing line includes a solenoid therein which provides flow communication only during periods of any defrost.

14. For use in a hot gas defrost refrigeration system having at least one compressor, a hot gas discharge line, at least one condenser, a receiver, a plurality of evaporators and associated expansion valves, a receiver line responsive to a predetermined minimum pressure within the receiver to selectively connect the hot gas discharge line thereto to increase the pressure within the receiver to a level sufficient to assure efficient operation of the expansion valves, a hot gas defrost means for selectively passing hot gaseous refrigerant through a desired evaporator, a discharge pressure control responsive to modulate flow through the hot gas discharge line to assure adequate pressure for effective operation of the hot gas defrost means, the improvement which comprises;

a. a balancing line providing refrigerant flow communication between the receiver and the discharge line;

b. a normally closed solenoid positioned within said balancing line and operable to open during defrost to allow the refrigerant pressure to equalize between said receiver and said hot gas discharge line; and c. a one-way check valve positioned to prevent refrigerant flow from the hot gas discharge line to the receiver an to allow refrigerant flow from the receiver to the hot gas discharge line.

* * * * *